US006146223A

United States Patent [19]

Karls et al.

[11] Patent Number: 6,146,223

[45] Date of Patent: Nov. 14, 2000

[54] MARINE PROPULSION UNIT WITH WATER INLETS IN ALL QUADRANTS OF THE FRONT PORTION OF ITS TORPEDO-SHAPE GEARCASE

[75] Inventors: Michael A. Karls, Hilbert; Robert B. Weronke, Oshkosh; Jeffrey J. Andrews, Fond du Lac, all of Wis.

[73] Assignee: Brunswick Corporation, Lake Forest, Ill.

[21] Appl. No.: 09/294,974

[22] Filed: Apr. 19, 1999

[51] Int. Cl.[7] ..... B63H 21/10

[52] U.S. Cl. ..... 440/88; 440/78

[58] Field of Search ..... 440/88, 89, 80

[56] References Cited

U.S. PATENT DOCUMENTS

| | | | |
|---|---|---|---|
| 2,656,812 | 10/1953 | Kiekhaefer | 440/88 |
| 3,447,504 | 6/1969 | Shimacnkas | 440/75 |
| 3,487,803 | 1/1970 | Alexander, Jr. | 440/75 |
| 4,016,825 | 4/1977 | Pichl | 440/88 |
| 4,832,635 | 5/1989 | McCormick | 440/88 |
| 4,832,639 | 5/1989 | Karls et al. | 440/88 |
| 5,009,622 | 4/1991 | Dudney | 440/88 |
| 5,078,630 | 1/1992 | Katsumata | 440/88 |
| 5,215,487 | 6/1993 | Gruber | 440/88 |
| 5,522,745 | 6/1996 | Rodskier | 440/61 |
| 5,766,046 | 6/1998 | Ogino | 440/78 |
| 5,791,950 | 8/1998 | Weronke et al. | 440/75 |
| 5,902,160 | 5/1999 | Weronke et al. | 440/88 |

*Primary Examiner*—Jesus D. Sotelo
*Attorney, Agent, or Firm*—William D. Lanyi

[57] ABSTRACT

A marine propulsion device is provided with a water inlet system that comprises at least a plurality of frontal inlet openings at the tapered forward end of a gearcase portion of a housing structure. The water inlet system can be provided for an outboard motor or a stern drive unit. Additional water flow can be provided through side inlet formed in the housing structure of the marine propulsion device where both the frontal inlet openings and side inlet openings are connected with fluid communication with the water pump mounted within the housing structure.

20 Claims, 8 Drawing Sheets

MARINE PROPULSION UNIT WITH WATER INLETS IN ALL QUADRANTS OF THE FRONT PORTION OF ITS TORPEDO-SHAPE GEARCASE

BACKGROUND OF THE INVENTION

1. Field of the Invention

The present invention is generally related to a marine propulsion unit that provides four or more water inlets at the forward portion of its bullet-shaped gearcase and, more particularly, to a marine propulsion unit which additionally provides side water inlets at the sides of its gearcase housing.

2. Description of the Prior Art

Most marine propulsion systems utilize water cooling to control the temperature of an internal combustion engine. Both outboard motors and stern is drive units take water into their cooling systems through water inlets that are located below the water level of a body of water in which the propulsion unit is operated. A water pump is used to draw water through the openings in the housing of the marine propulsion unit and force the water through cooling channels in the internal combustion engine.

U.S. Pat. No. 4,832,635, which issued to McCormick on May 23, 1989, discloses a nose construction for the gearcase of a marine drive. The marine drive unit includes a lower propeller torpedo housing of generally cylindrical configuration having a longitudinal centerline. A propeller shaft is mounted in the housing for rotation on a axis offset from the centerline. The shaft is journalled in a forward bearing assembly which is held in place by a support adjustably mounted to the housing and on the offset axis. A nose is removably secured to the forward housing end by a mounting bolt which extends into the support on the offset axis. A single multi-purpose opening or port in the forward end of the nose communicates to an interior entry passage in the nose. The entry passage, in turn, merges into a pair of passage branches. One branch is disposed on the offset propeller shaft axis and receives the mounting bolt. The other branch is positioned to communicate with the cooling water passages in the lower unit, and which lead to the marine drive engine. A torque retention and sealing member is disposed between the support and the nose. Furthermore, a torque retention and sealing member is disposed between the bulkhead and the inner end of its passage branch.

U.S. Pat. No. 5,791,950, which issued to Weronke et al on Aug. 11, 1998, discloses a twin propeller marine propulsion unit. The improved marine propulsion unit comprises a vertical driveshaft which is journalled in the lower gearcase and drives a pair of bevel gears. A pair of concentric propeller shafts are mounted in the lower torpedo section of the gearcase and each shaft carries a propeller. A slidable clutch is movable between a neutral, a forward, and a reverse position and serves to operably connect the outer propeller shaft with one of the bevel gears when the clutch is moved to the forward drive position. A gear is mounted for sliding movement in unison with the clutch and acts to operably engage the inner propeller shaft with the second bevel gear when the clutch is in the forward drive position so that both propellers are driven in opposite directions to provide forward motion for the water craft. The propulsion system also includes a dual cooling water pick-up system in which sea water is drawn to the water pump both through a series of vertical inlet ports in the gearcase and through a plurality of inlet holes that are located in the forward end of the lower torpedo section. Exhaust gas from the engine is discharged through the rear end of the lower housing section through axial passages in the hub of the forward propeller and then across the outer surface of the rear propeller.

U.S. Pat. No. 3,487,803, which issued to Alexander on Jan. 6, 1970, describes an outboard drive unit for a watercraft. A generally horizontal propeller shaft is rotatably disposed in the lower unit of an outboard drive and projects from the unit to carry a propeller. A generally vertical drive shaft is rotatably disposed in the drive shaft housing of the outboard drive and extends downwardly into the lower unit with the lower end of the drive shaft spaced above the propeller shaft. A plurality of generally vertical driven shafts are disposed in the lower unit and are drivingly connected to the propeller shaft. Reversing gear means connect the drive shaft to the driven shafts and provide for propeller rotation selectively in the forward and reverse directions. The invention further contemplates a transmission arrangement wherein changes in gear ratio can be made to suit the type of operation contemplated for the drive unit. A plurality of water inlets is provided on the nose of a torpedo-shaped portion of the lower unit.

U.S. Pat. No. 5,009,622, which issued to Dudney on Apr. 23, 1991, discloses cooling systems for marine motors. The cooling system has a coolant path which is external to the motor housing of the motor. The external coolant path is connected across the inlet and outlet of the internal coolant path through which coolant is normally conveyed to cool the hot zones of the motor. A closed circuit is thus formed. The external coolant path includes a heat exchanger arranged to place the coolant in heat exchange relationship with water in which the motor runs. It may also include a header tank for pressure control and topping up purposes. The external path can be in kit form for conversion of existing motors. The motor may be an inboard or outboard motor.

U.S. Pat. No. 5,215,487, which issued to Gruber on Jun. 1, 1993, describes a marine propulsion device water inlet screen. The propulsion device comprises a housing including a side wall having therein a water inlet and having an outer surface which extends generally in the fore and aft direction and which includes a ramped portion having a forward end and sloping rearwardly and outwardly from the inlet, and a forwardly-facing portion partially defining the inlet and extending inwardly from the forward end of the ramped portion, a water inlet screen covering the inlet and including a inner surface which slopes rearwardly and outwardly and which engages the ramped surface portion of the housing, screws for securing the screen to the housing, and a propeller shaft rotatably supported by the housing.

U.S. Pat. No. 4,016,825, which issued to Pichl on Apr. 12, 1977, discloses a device for driving a boat propeller and cooling water pump. A device for powering a propeller and a cooling water pump by a boat engine via a downwardly directed drive leg is disclosed, which supports a hollow intermediate shaft for driving the propeller shaft. Between the crankshaft and the intermediate shaft there is arranged a reversible gear device. A shaft for powering the cooling water pump impeller is rigidly attached to the engine crankshaft and rotatably passes through the intermediate shaft of the impeller.

U.S. Pat. No. 3,447,504, which issued to Shimanckas on Jun. 3, 1969, discloses a marine propulsion lower unit. The marine propulsion device comprised a lower unit including therein a rotatably mounted propeller shaft extending only at one end from the lower unit and a second shaft rotatably mounted in the lower unit and extending in acute angular relation to the propeller shaft. A third shaft is rotatably mounted in the lower unit and double gearing connections are provided between the propeller shaft and between the second and third shafts.

U.S. Pat. No. 5,766,046, which issued to Ogino on Jun. 16, 1998, described a cooling water pickup for a marine propulsion unit. The improved water pickup arrangement for a marine propulsion device for picking up cooling water for the propelling, water cooled internal combustion engine, is disclosed. The lower unit has a bullet-shaped portion and the water inlet openings are formed at the forward and upper ends of this portion.

U.S. Pat. No. 5,522,745, which issued to Rodskier on Jun. 4, 1996, describes a boat propulsion unit. The unit is intended to be suspended on the outside of the boat transom and comprises a propeller drive shaft housing, a suspension arrangement intended to be fixedly secured to the transom, and a pivot for the drive shaft housing to allow pivotal displacement of the drive shaft housing relative to the suspension arrangement about a pivot axis in a vertical plane and a pivot axis in a horizontal plane. A steering device effects pivotal displacement of the drive shaft housing about the first mentioned axis, and trim end tilt structure effects pivotal displacement of the drive shaft housing about the second-mentioned axis. The trim structure comprises at least one piston-cylinder arrangement having a cylinder space in communication with a water inlet such that the ram pressure created by the water flowing into the water inlet and dependent on the speed of the boat during forward motion generates a pressure in the cylinder space which strives to trim the propulsion unit away from the transom, and a spring the force of which acts only in the same direction as the water pressure prevailing in the cylinder space. The spring is disposed in the cylinder on only one side of the piston.

U.S. Pat. No. 2,656,812, which issued to Kiekhaefer on Oct. 27, 1953 describes a gearcase unit for outboard motors. The bullet-shaped portion of the gearcase is provided with a plurality of openings formed through a cylindrical portion of the bullet-shaped gear case.

U.S. Pat. No. 5,078,630, which issued to Katsumata on Jan. 7, 1992, discloses an engine cooling system induction arrangement for a marine inboard-outboard and outboard engine. The marine outboard engine has a section of its cooling water suction passage defined by an annular groove formed in the periphery of a bearing housing which accommodates the bearing of the propeller shaft. This allows the suction passage to be connected to a water intake formed on a lower section of the torpedo of the engine without the need to increase the size of the torpedo. This results in a smaller, lighter configuration for the lower case while still allowing the engine to be operated in a super high mount operating mode which is appropriate for use with a super cavitation propeller, due to the low position of the cooling water intake.

U.S. Pat. No. 4,832,639, which issued to Karls et al on May 23, 1989, discloses a marine drive with an air trap for an auxiliary water inlet. The marine propulsion unit has a depending gearcase with one or more water inlet openings in the sides of the gearcase for supplying water to a water pump, and an auxiliary water inlet opening at an anti-ventilation plate above the propeller for supplying additional water to the water pump. The water passage from the auxiliary water inlet opening to the water pump has a portion extending downwardly below the level of the auxiliary water inlet opening and communicating with the side water inlet openings. When the side water inlet openings are below the water line and the auxiliary water inlet is above the water line, water is received in the downwardly extending portion of the second passage and blocks air form flowing from the auxiliary inlet opening to the water pump, to prevent engine overheating.

SUMMARY OF THE INVENTION

A marine propulsion device for a watercraft made in accordance with the present invention comprises an engine which has a cooling system through which water can flow in thermal communication with heat producing components of the engine. The engine has an output shaft which is rotatably supported and at least partially contained within a housing structure. The housing structure is generally referred to as a drive shaft housing.

A propeller shaft is rotatably supported and at least partially contained within a gearcase portion of the housing structure with the propeller shaft being in torque transmitted relation with the output shaft of the engine. The gearcase portion of the housing structure has a tapered forward end which is generally torpedo-shaped or bullet-shaped.

The marine propulsion device made in accordance with a particular preferred embodiment of the present invention further comprises a water inlet system comprising a first conduit formed within the housing structure. The first conduit is connected in fluid communication with a plurality of frontal inlet openings formed through a wall thickness of the tapered forward end of the gearcase portion of the housing. First, second, third, and fourth frontal inlet openings are located above a horizontal centerline and to the left of a vertical centerline of the tapered forward end of the gearcase portion, above the horizontal centerline and to the right of the vertical centerline, below the horizontal centerline and to the left of the vertical centerline, and below the horizontal centerline and to the right of the vertical centerline, respectfully. The four frontal inlet openings are therefore disposed in four quadrants of the tapered forward end of the gearcase portion with at least one inlet located above and below the horizontal centerline and to the left and right of the vertical centerline. Each of the four frontal inlet openings have a forward facing area. The water inlet system is connected in fluid communication with the cooling system of the engine.

Each of the plurality of frontal inlet openings can be an individual hole formed through the wall thickness of the gearcase portion. Alternatively, two or more of the plurality of frontal inlet openings can be formed by a single hole formed through the wall thickness of the gearcase.

The propulsion device can further comprise a first chamber formed within the tapered forward end of the gearcase portion and connected in fluid communication between the first conduit and the plurality of frontal inlet openings formed through the wall thickness of the tapered forward end of the gearcase portion. The effective diameter of the forward facing area of each of the plurality frontal inlet openings is greater than the wall thickness of the tapered forward end of the gearcase portion. In a particularly preferred embodiment of the present invention, the effective diameter of the forward facing area of each of the plurality of frontal inlet openings is at least 25% greater than the wall thickness.

The propulsion device of the present invention can further comprise a plurality of side inlet openings formed through a side wall of the housing structure. A second conduit is formed within the housing structure in fluid communication with the plurality of side inlet openings. The first and second conduits can be connected in fluid communication with each other and with a cooling system of the engine.

The marine propulsion device of the present invention, in a particularly preferred embodiment, further comprises a water pump disposed within the housing structure and connected in fluid communication with the first and second conduits between the cooling system of the engine and the first and second conduits. The marine propulsion system can be an outboard motor or, alternatively, a stem drive unit.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
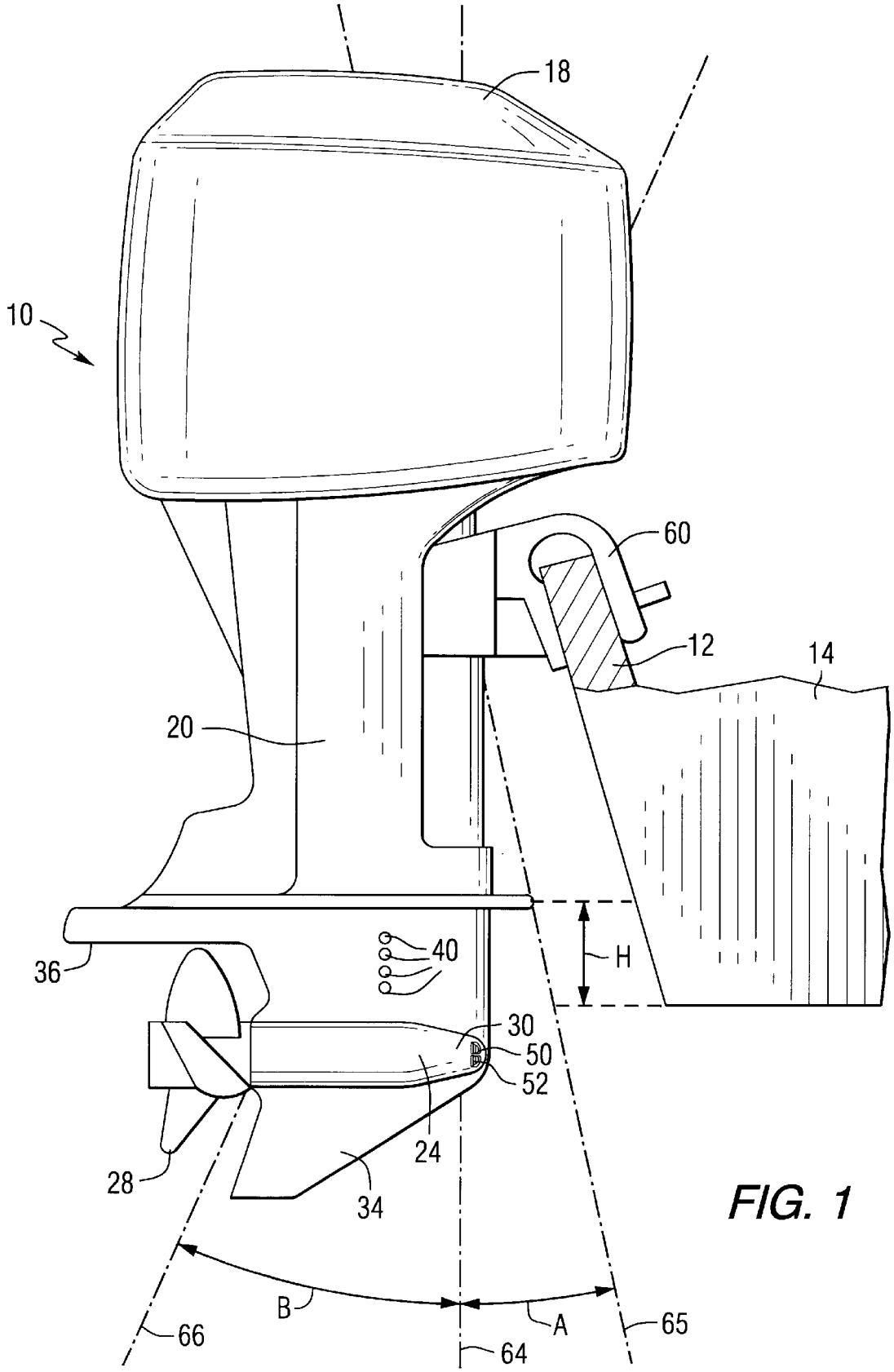
FIG. 1 shows an outboard motor mounted to a transom of a water craft.

Throughout the description of the preferred embodiment of the present invention, like components will be identified by like reference numerals.

FIG. 1 shows an outboard motor 10 attached to a transom 12 of a watercraft 14. The outboard motor comprises an engine disposed under a cowl 18 with a downwardly extending driveshaft (not shown) which is rotatably supported for rotation about a vertical axis within a driveshaft housing 20. The housing of the outboard motor 10 also comprises a gearcase housing 24 in which a propeller shaft is rotatably supported for rotation about a horizontal centerline. The propeller shaft is connected in torque transmitting relation with the driveshaft which, in turn, is driven by the engine. A propeller 28 can be attached to the propeller shaft within the gearcase portion 24 of the housing. The gearcase portion is torpedo-shaped or bullet-shaped and has a tapered forward end 30. The housing also supports a skeg 34 and an anti-cavitation plate 36.

The outboard motor 10 in FIG. 1 is shown with a plurality of side inlet openings 40 formed through a wall thickness at the sides of the central portion of the gearcase portion 24. In addition, frontal inlet openings, 50 and 52, are shown formed through the wall thickness of the tapered forward end 30 of the gearcase portion 24.

With continued reference to FIG. 1, it can be seen that the outboard motor 10 is supported by a bracket 60 which is attached to the transom 12 of the watercraft 14. The outboard motor 10 can rotate about a centerline 64 for purposes of steering. In many applications of outboard motors, the support structure is provided with a capability for trimming or tilting the outboard motor structure relative to the vertical centerline 64. In other words, centerline 64 can be moved to the position identified by centerline 65 in FIG. 1. This moves the gearcase portion 24 closer to the watercraft 14 and tilts the cowl 18 in a rearward direction relative to the transom 12. Alternatively, centerline 64 can be tilted or trimmed to the position shown by centerline 66 in which the gearcase portion 24 is moved farther from the watercraft 14 while the cowl 18 is moved forwardly. A trim and tilt arrangement for an outboard motor 10 can allow the centerline 64 to be tilted or trimmed approximately 2° inwardly are represented by arrow A or approximately 18° outwardly as represented by arrow B, relative to the vertical position represented by centerline 64. This is equivalent to the resulting angle between the propeller shaft centerline and the bottom of the boat. Because the outboard motor 10 is able to pivot about an axis that is significantly above the location of the side inlet openings 40, trimming or tilting the outboard motor outwardly, as represented by arrow B, has the effect of raising the side inlet openings 40. Under certain running conditions, the side inlet openings 40 can experience a disadvantageous effect when the outboard motor 10 is trimmed outwardly by a significant angle. For example, under certain conditions, the side inlet openings 40 can be raised sufficiently to lift them above the waterline when the boat is operated. Furthermore, certain hull structures of watercraft 14 cause excessive aeration behind the bottom surface of the hull and in the stream of water in which the side inlet openings 40 must draw water into the housing structure for cooling of the internal combustion engine under the cowl 18.

Figure 2:
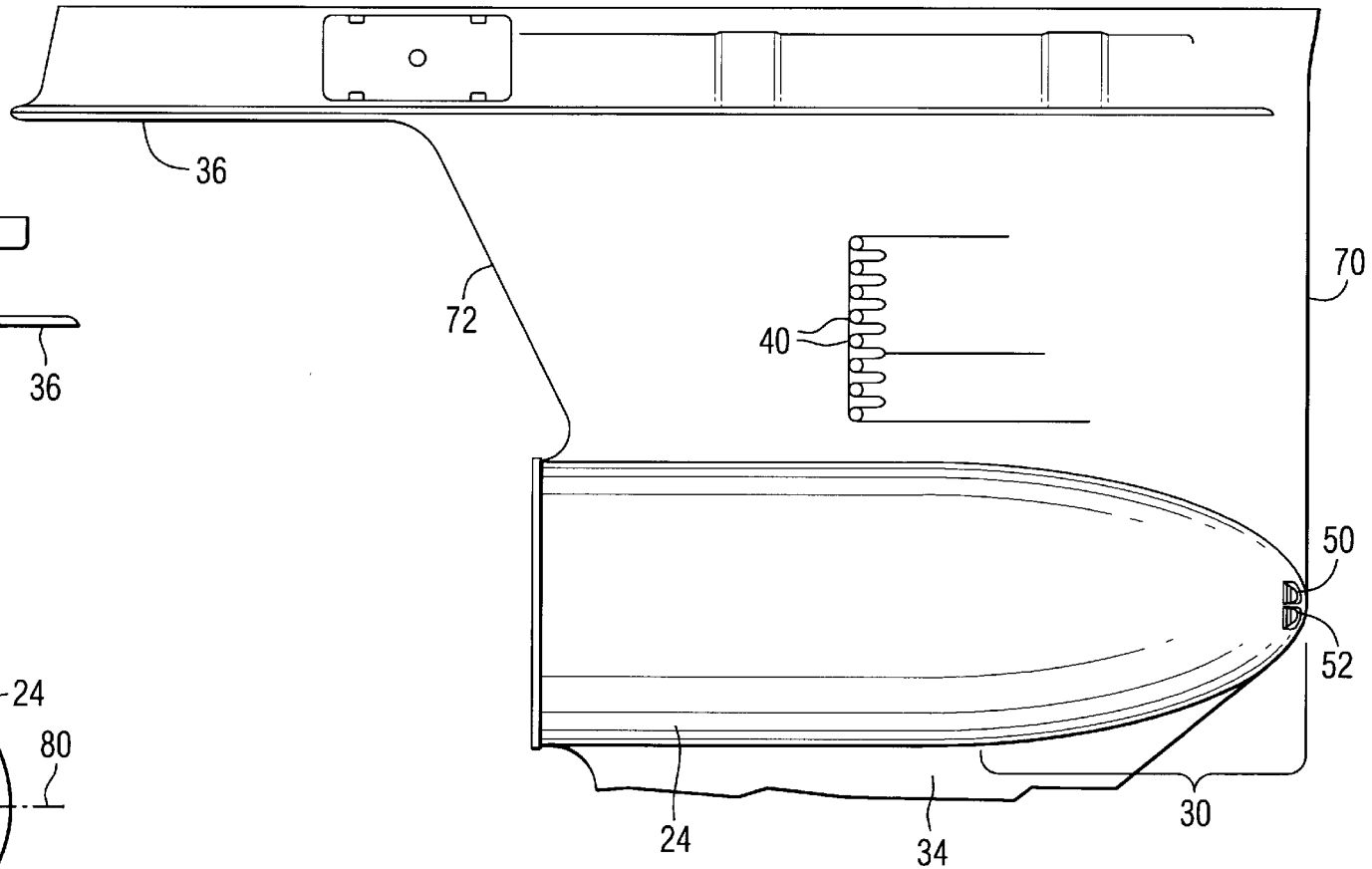
FIG. 2 is a side view of a gearcase housing.

To solve the problem described immediately above, the present invention provides frontal inlet openings, such as 50 and 52, to significantly improve the provision of cooling water for the engine under all conditions of operation, including severe trim angles of the outboard motor 10. FIG. 2 shows a side view of a specific housing for a lower unit of an outboard motor, with the gearcase portion 24 and skeg 34 at its lower portion. As can be seen, the gearcase portion 24 is generally torpedo-shaped, or bullet-shaped, and has a tapered forward end 30. The rear portion of the gearcase housing 24 is generally cylindrical. A leading edge 70 of the housing and a trailing edge 72 of the housing are shown above the gearcase portion 24. In the region of the housing above the torpedo-shaped gearcase portion 24, a plurality of side inlet openings 40 both sides of the housing structure. Under most conditions, the side inlet openings 40 are sufficient to provide an inward flow of water into the housing structure for the purposes of cooling the internal combustion engine. However, as described above, certain conditions of trim of the outboard motor 10 raise the side inlet openings 40 out of the water or place the side inlet openings 40 in regions of extreme aeration so that it is not possible for sufficient water to be drawn into the cooling system through the side inlet openings 40. The present invention provides frontal inlet openings, such as 50 and 52 in FIG. 2, to provide inlet flow of water, under ram conditions, into the water inlet system.

Figure 3:
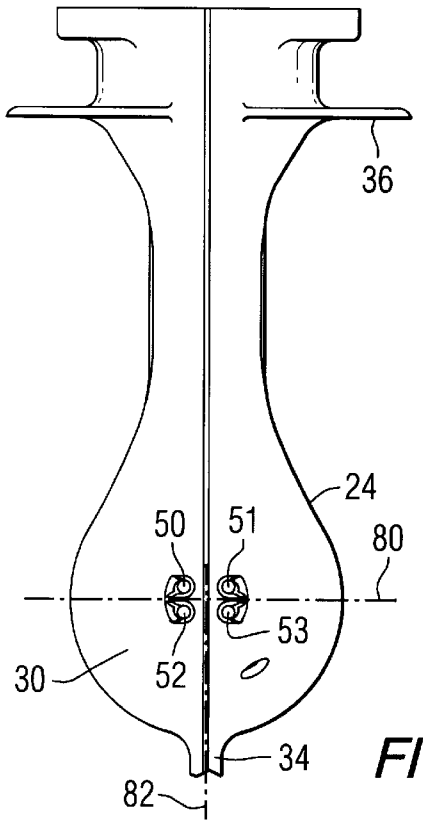
FIG. 3 is a frontal view of the housing shown in FIG. 2.

FIG. 3 shows a frontal view of the lower portion of a housing structure. The tapered forward end 30 of the gearcase portion 24 is provided with a plurality of frontal inlet openings, 50–53, which each have a forward facing area. This forward facing area of each of the frontal inlet openings allows water to be forced into the water inlet system under ram pressure when the propulsion device is in operation to move the watercraft. This can be seen in FIG. 3, the four frontal inlet openings are located in the four quadrants formed by the horizontal centerline 80 of the gearcase portion 24 and the vertical centerline 82 of the gearcase portion. Frontal inlet openings 50 and 51 are located above the horizontal centerline 80 while frontal inlet openings 52 and 53 are located below it. Frontal inlet openings 50 and 52 are located to the left side of vertical centerline 82 while frontal inlet openings 51 and 53 are located to the right side of the vertical centerline, as viewed in FIG. 3.

Figure 4:
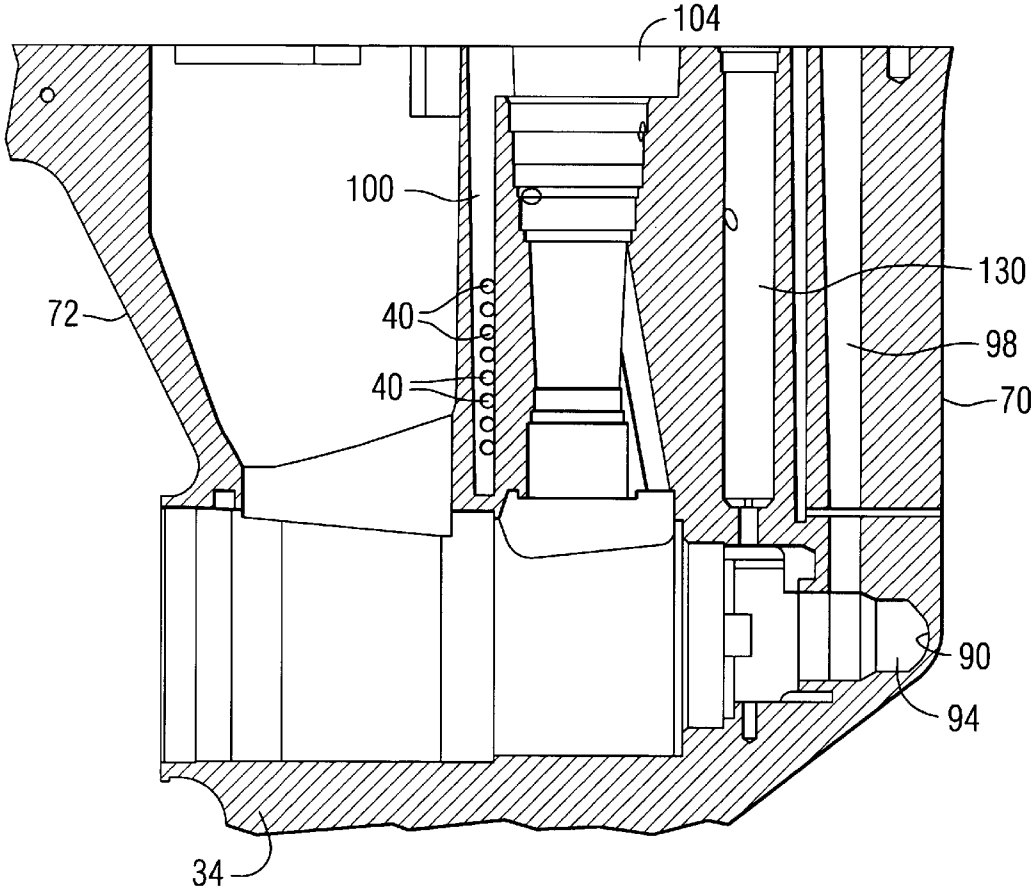
FIG. 4 is a sectional view of the housing shown in FIG. 2 taken through the plane of a propeller shaft and driveshaft centerlines.

FIG. 4 is a sectional view of the lower portion of the housing, taken through the housing at its vertical centerline. Because of the particular surface formed by the section view of FIG. 4, the frontal inlet openings 50–53 are not visible in FIG. 4. However, it should be understood that all four of the frontal inlet openings 50–53 are formed through the wall 90 in front of a first chamber 94 that is formed within the tapered forward end of the gearcase portion. A first conduit 98 is formed through the housing and is in fluid communication with the first chamber 94 and the four frontal inlet openings 50–53. The side inlet openings 40 are connected in fluid communication with a second conduit 100.

In FIG. 4, a space 104 is formed and shaped to receive a water pump. As will be described below in greater detail, the first conduit 98 is connected in fluid communication with the second conduit 100 by providing passages therebetween. In certain embodiments of the present invention, the first conduit 98 and the second conduit 100 are both connected in fluid communication with the water pump in space 104.

Figure 5:
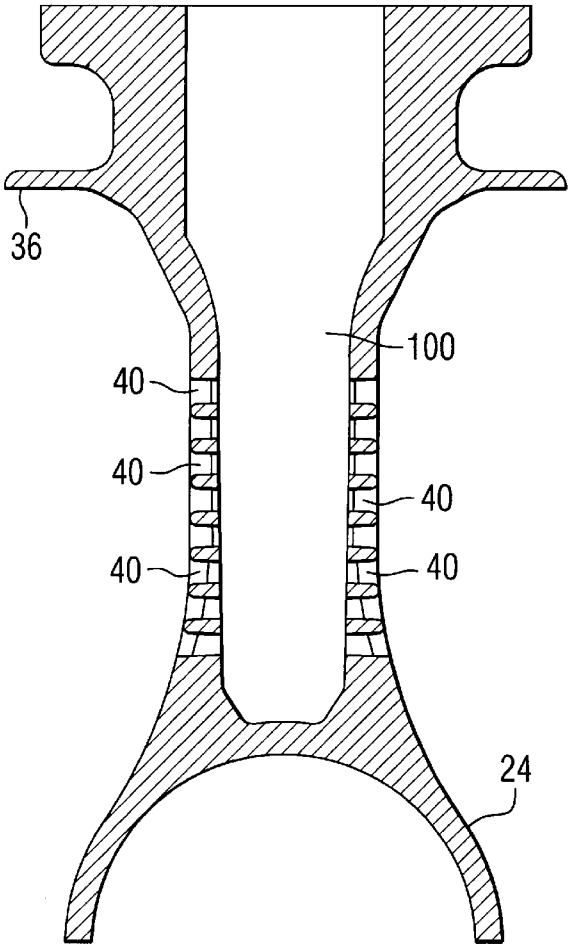
FIG. 5 is a sectional view of the housing shown in FIG. 2 taken through the side water inlets.

FIG. 5 is a section view showing the side inlet openings 40 connected in fluid communication with the second conduit 100 which is a vertical channel that can convey water upwardly toward the location of a water pump.

Figure 6:
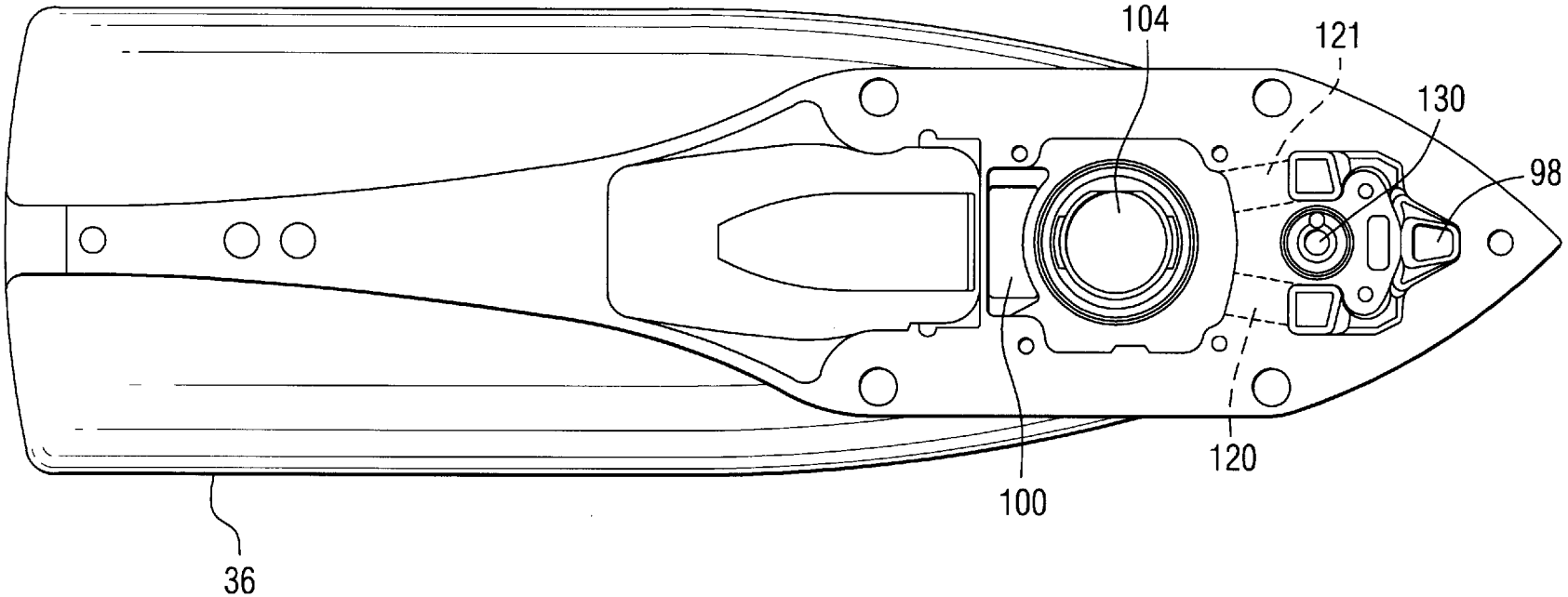
FIG. 6 is a top view of the housing shown in FIG. 2.

FIG. 6 is a top view of the housing portion shown in FIG. 2. In FIG. 6, the first conduit 98 can be seen extending upwardly through the upper surface of the housing segment. Similarly, the second conduit 100 is also shown extending upwardly through the upper surface of the housing segment. Space 104 is shaped to receive a water pump that is in fluid communication with the second conduit 100. Two holes, 120 and 121, are formed through a portion of the housing shown in FIG. 6 to provide fluid communication between the first conduit 98 and the water pump that is located in location 104. Reference numeral 130 identifies a vertical opening through which a shift shaft is disposed to enable an operator to change gears within the gearcase portion 24. It should be understood that the first conduit 98 is in fluid communication, around the shift shaft position and through openings 120 and 121, with the water pump disposed in location 104.

Figure 7:
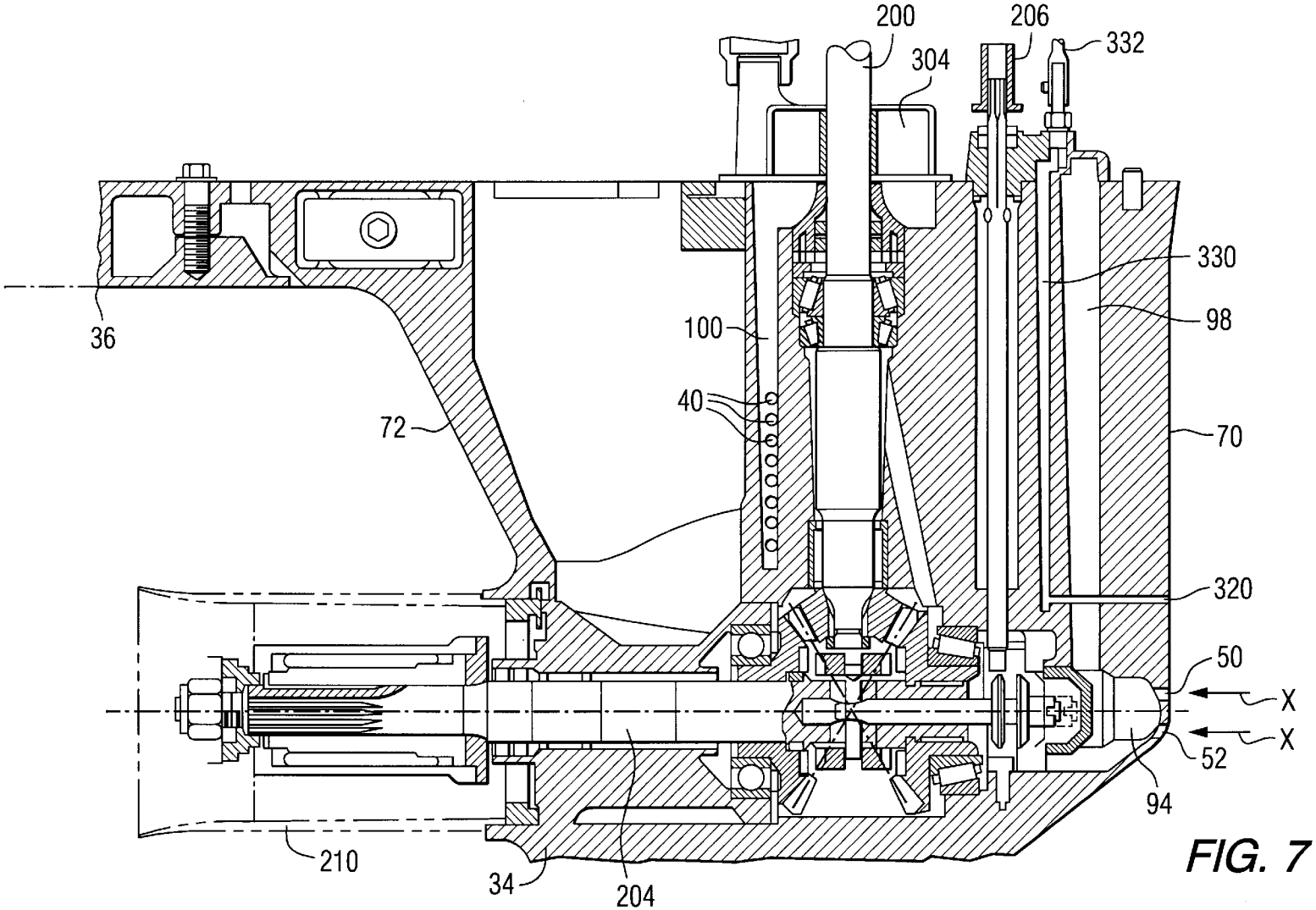
FIG. 7 is a sectional view of a housing showing the drive shaft, the propeller shaft, interconnecting gears, and the water passages provided by the present invention.

FIG. 7 is a section view of the gearcase portion with the gears, drive shaft 200, propeller shaft 204 and shift shaft 206 shown. The plurality of side inlet openings 40 can be seen connected in fluid communication with the second conduit 100. A portion of the tapered forward end has been resectioned to show two of the frontal inlet openings, 50 and 52 with arrows X representing the direction of flow of water entering the forward facing areas of the frontal inlet openings. As shown in FIG. 7, the frontal inlet openings are connected in fluid communication with the first chamber 94 which, in turn, is connected in fluid communication with the first conduit 98. A propeller shaft 204 is connected in torque transmitting relation with the drive shaft 200 through a set of bevel gears as shown. A propeller hub 210 is illustrated by dashed line to represent the location of a propeller at the distal end of the propeller shaft 204. A water pump 304 is shown connected in driving relation with the drive shaft 200 and in fluid communication with the second conduit 100. Although the two passages identified by reference numerals 120 and 121 in FIG. 6 are not visible in FIG. 7, it should be understood that the first conduit 98 is also connected in fluid communication with the water pump 304.

An additional hole 320 in the leading edge 70 of the housing provides a pressure pickup that transmits pressure, through the conduit identified by reference numeral 330, to a pressure sensor 332. However, it should be understood that the pressure sensor 332 and its pickup location 320 are not related directly to the present invention.

With reference to FIGS. 1, 2, and 3, it can be seen that when the outboard motor 10 is trimmed to the position represented by centerline 66, the 2 lower frontal inlet openings 52 and 53, may be deprived of a full flow of water to provide those frontal inlet openings with ram pressure to force water into the housing. However, even when the outboard motor 10 is trimmed to the position represented by centerline 66 in FIG. 1, the two upper frontal inlet openings, 50 and 51, are in a particularly advantageous position to receive the flow of water under ram pressure due to the movement of the water craft 14. Similarly, regardless of whether the outboard motor 10 is turned to the left or to the right about its vertical centerline, either holes 50 and 52 or holes 51 and 53 will be in a particularly advantageous position to receive water under ram pressure as a result of the movement of the water craft 14 through the water. As a result, the group of frontal inlet openings 50–53 are not disadvantageously affected by either trimming the outboard motor 14 or turning the outboard motor about the centerline for purposes of steering the water craft 14. Therefore, the provision of a plurality of frontal inlet openings 50–53 provides a significant beneficial advantage over outboard motors known to those skilled in the art.

When the outboard motor 14 is tilted in an extreme trimmed out position as represented by centerline 66 in FIG. 1, the side inlet openings 40 may be significantly deprived of sufficient water flow for their use in cooling the engine. Under these conditions, when the side inlet openings 40 do not receive sufficient water to properly cool the engine, the frontal inlet openings 50–53 will provide more than sufficient water flow to overcome this deprivation. In fact, the ram pressure experienced by the frontal inlet openings 50–53 is usually sufficient to actually cause water to flow out of the side inlet openings 40 after passing upward through the first conduit 98, through passages 120 and 121, past the water pump 304, and downwardly through the second conduit 100. This effect has been empirically shown and has the additional beneficial effect of providing a water flow into a low pressure region along the side surfaces of the housing near the side inlet openings 40. This flow of water into the low pressure region provides additional benefits relating to stability and control of the outboard motor. It is also indicative of the more than sufficient water flow provided by the frontal inlet openings 50–53.

Figure 8:
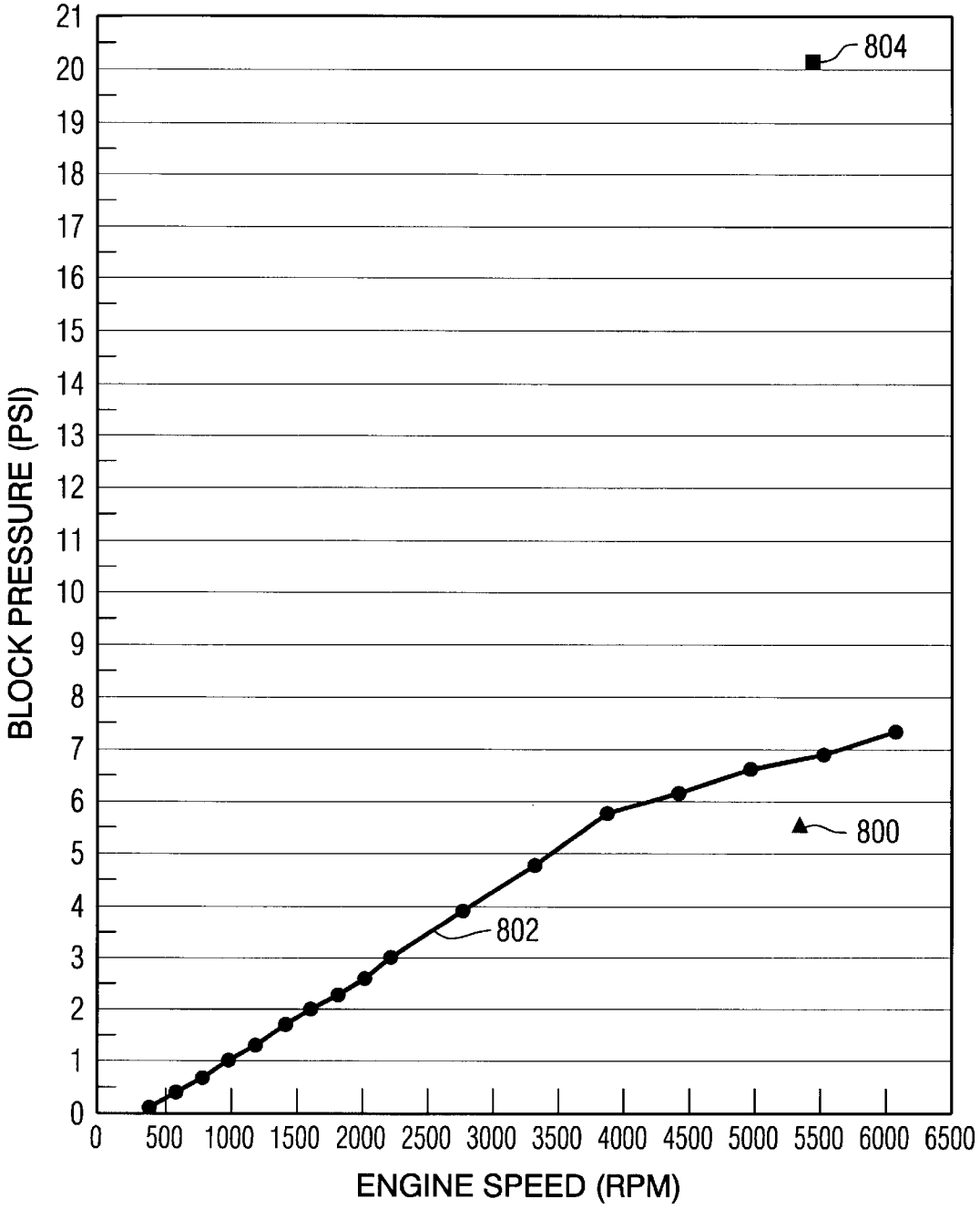
FIGS. 8 and 9 are graphical representations of various tests made to compare the present invention to known gearcases.

The present invention has been tested, in comparison to existing gearcase design and existing water inlet configurations, to determine its actual performance relative to the prior art devices. FIG. 8 is a graphical representation of engine block pressure, within its cooling system, as a function of engine speed when the outboard motor 10 is trimmed for best speed in the direction of trim angle B, as shown in FIG. 1, to a magnitude of approximately 8° to 10°. The point identified by reference numeral 800 represents a known gearcase with side inlet openings 40, but no frontal inlet openings such as those identified by reference numerals 50–53 of the present invention. Line 802 represents a minimum block pressure line. If the block pressure is below line 802, an alarm would be typically sounded to indicate a low block pressure condition. Under identical conditions, a gearcase made in accordance with the present invention provided a block pressure in excess of 20 PSI, as represented by point 804 in FIG. 8. The empirical data represented by points 800 and 804 in FIG. 8 show that the present invention provides more than sufficient block pressure when the present invention is used on an outboard motor mounted on a 33 ft Intrepid boat with dual 3.0 liter 200 hp Mercury Optimax outboard motors which are trimmed for best speed. In FIG. 8, both points 800 and 804 represent the average of six data points.

Figure 9:
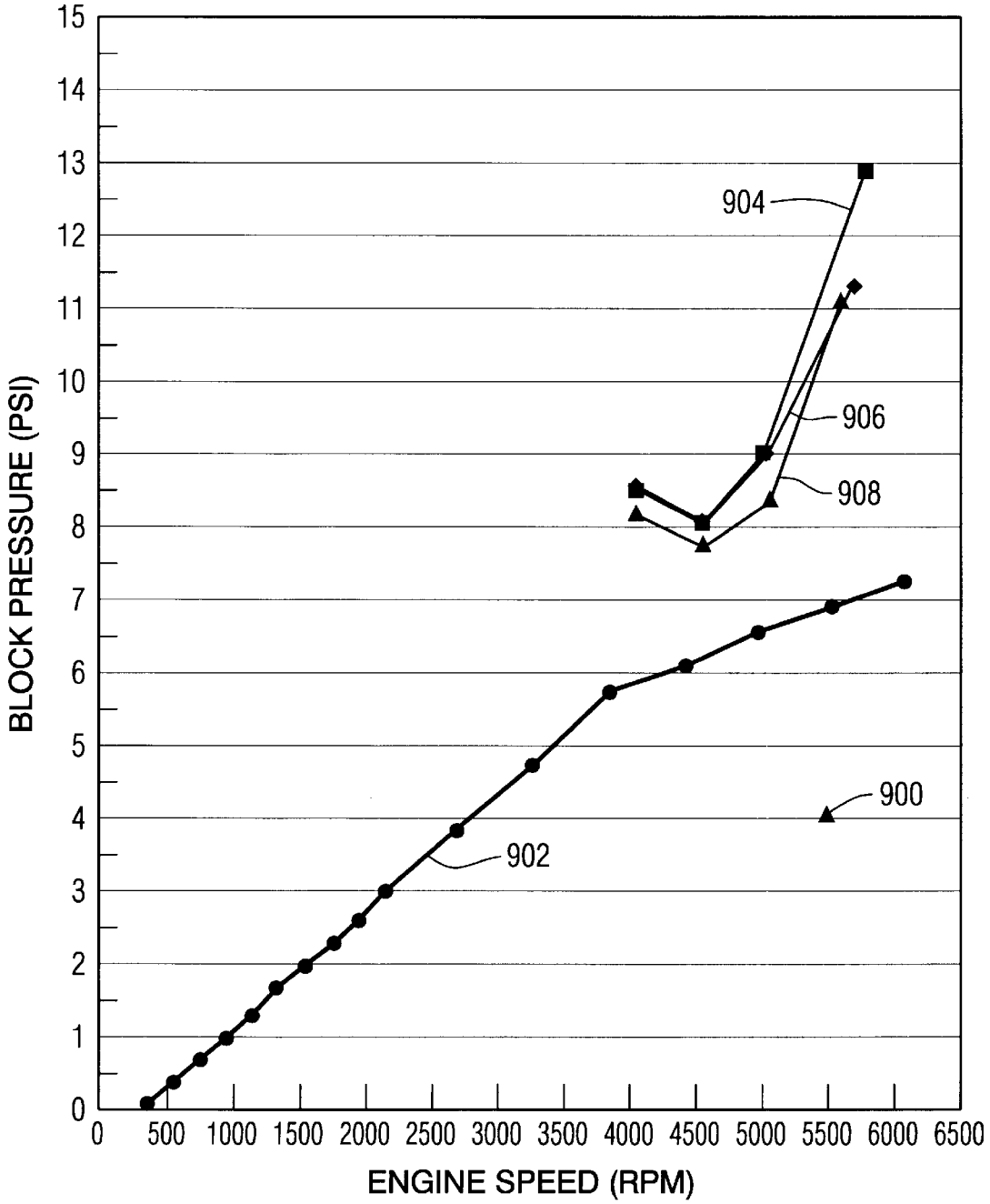

FIG. 9 is generally similar to FIG. 8, but represents empirical data taken when the outboard motors are trimmed to their maximum outward trim position represented by centerline 66 in FIG. 1, which is approximately 18°. Data point 900, taken with a known gearcase having only side inlet openings, represents an alarm condition because it is less than the standard represented by line 902. To assure proper operation of the present invention, several empirical tests were performed. Line 904 represents data for the gearcase of the present invention with the antiventilation plate 2.5 inches above the boat bottom at wide open throttle and at maximum trim. The outboard motor had 16 strut or side inlets 40 and the data was taken in reverse order with decreasing steps of 500 RPM until the speed was reduced to 4000 RPM. The data represented by line 906 in FIG. 9 is generally similar to that represented by line 904, but with ten side inlets. For purposes of this test, some of the side inlets 40 were blocked. The line identified by reference numeral 908 in FIG. 9 represents the present invention with an outboard motor antiventilation plate 1.75 inches above the boat bottom operated at wide open throttle and at maximum trim, backing down in speed with steps of 500 RPM until the speed reached 4000 RPM. The unit identified by this line 908 had 16 side inlets 40 in additional to the frontal inlets of the present invention. As can be seen in FIG. 9, all of the points taken with the present invention are clearly above line 902 and acceptable, while the data representing point 900 with the known gearcase, did not reach acceptable block pressures.

Figure 10:
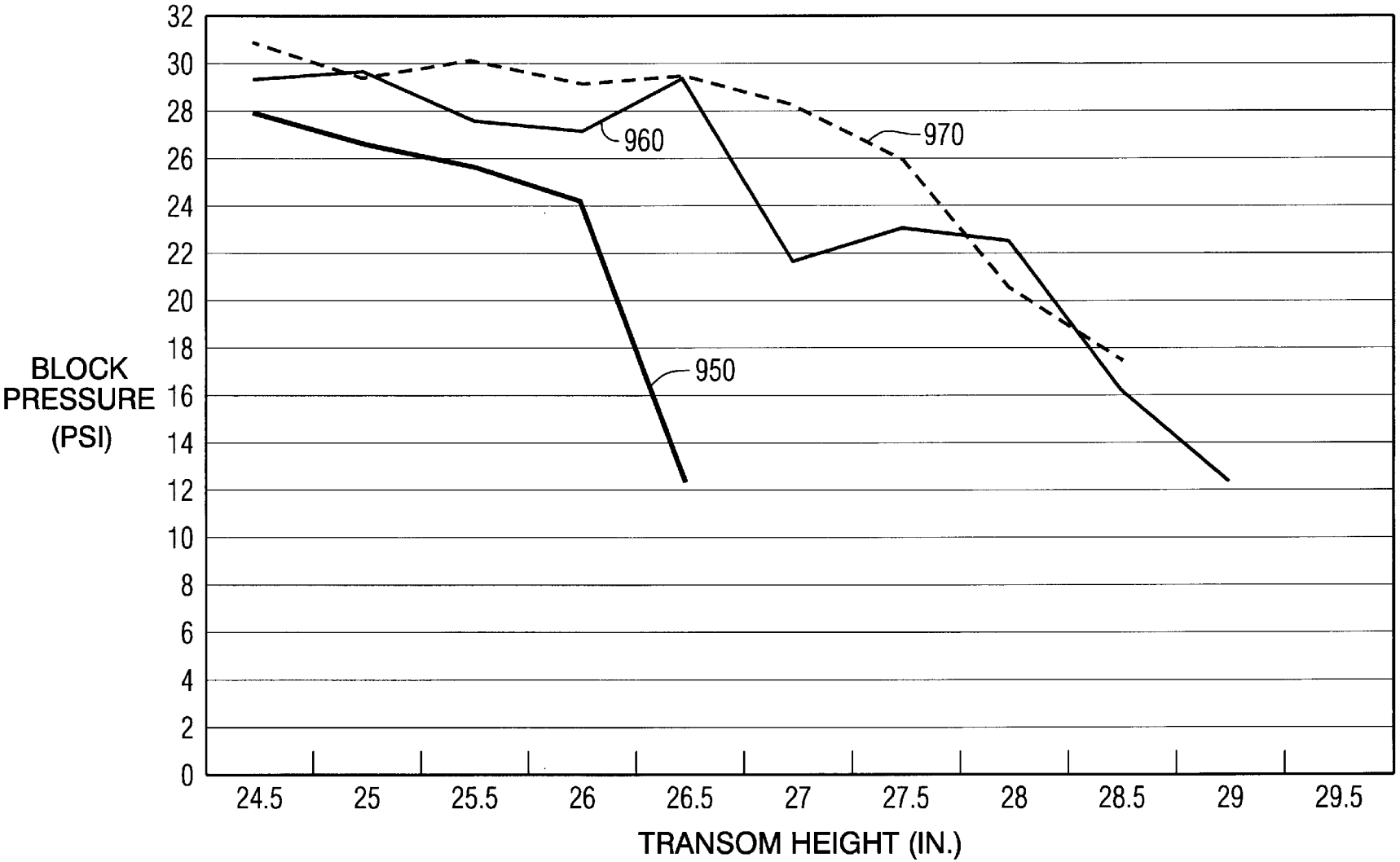
FIG. 10 is a graphical representation of several tests made at various transom heights to determine the acceptability of block pressures provided by the present invention in comparison to known gearcases.

To further test the acceptability of the present invention, several empirical tests were performed to further compare the present invention to known gearcase designs. FIG. 10 shows three lines plotted in a graphical representation of block pressure as a function of transom height, which essentially defines the relative vertical position of the outboard motor to the transom of a boat. With reference to FIGS. 1 and 10, dimension H in FIG. 1 for a 20 inch outboard motor housing length would be 20 inches less than the value represented by the horizontal axis in FIG. 10. In other words, with a transom height of 25 inches, dimension H in FIG. 1 would be 5 inches. Similarly, with the transom height of 28 inches, dimension H in FIG. 1 would be 8 inches. The test represented in FIG. 10 is important because some boat operators prefer to raise the outboard motor 10 relative to the transom 12 and the bottom of the watercraft 14. The higher the installation or transom height, the more likely the side inlet openings 40 are to be raised out of the water, particularly when the water craft 14 is operated at high speed. Eventually, the side inlet openings 40 are above the level of the water and are unable to draw water for cooling purposes. The tests represented by FIG. 10 were run with a 3.0 liter 225 HP Mercury Optimax outboard motor mounted on a is 300ZX Skeeter bass boat with a 27P Tempest propeller. The block pressures and boat speeds were monitored for various tests run at different transom heights. Line 950 represents the data for a standard known gearcase which did not include the frontal inlet openings 50–53 of the present invention. For all transom heights, the boat was operated at speeds between 71.6 and 73.6 miles per hour. As can be seen, the block pressures were all above 24.0 psi as long as dimension H in FIG. 1 was less than or equal to six inches. With the transom height set to 26.5 inches, the block pressure decreased significantly to approximately 12 psi. Any operation beyond this point would have likely resulted in damage to the outboard motor. Therefore, further data points at increased transom heights for the known gearcase were not run. Line 960 represents a series of tests, at different transom heights, run with the present invention having 16 side inlet openings. All of the tests were run at boat speeds between 72.2 and 75.2 miles per hour. As can be seen, the block pressures remained above 20 psi up to and including a transom height of 28 inches, or a dimension H of eight inches in FIG. 1. Line 970 in FIG. 10 represents a test run with the present invention having 10 side inlet openings. All tests were run at boat speeds between 71.7 and 73.5 miles per hour. As can be seen, the block pressure remained above 20 psi up to and including a transom height of 28 inches and, even at a transom height of 28.5 inches, the block pressure remained at a relatively acceptable level of 17.4 psi.

The data represented in FIG. 10 also shows that the present invention does not provide excessively high block pressures, even when run at high boat speeds. This could be a concern because high block pressures could result in leaks through gaskets and other water containment components of the engine. However, as represented by lines 960 and 970 in FIG. 10, the block pressure never exceeded 32 psi for any of the test points, which were all run at boat speeds in excess of 70 miles per hour.

The provision of the plurality of frontal inlet openings 50–53, with or without side inlet openings 40, allows the engine to receive sufficient water flow to properly cool the engine. Furthermore, the water is provided at reasonably high pressures that are not sufficiently high to damage the engine, but are adequate to provide an appropriate water flow to the engine at a wide range of transom height mounting positions. When used in conjunction with side inlet openings 40, the frontal inlet openings 50–53 can provide sufficient water flow under ram pressure to actually cause an out flow of water through the side inlet openings 40 under certain conditions. This out flow of water from the side inlet openings 40 can be beneficial because the water tends to flow into areas that would normally be at low pressure.

Although the present invention has been described with particular specificity and illustrated to show a particularly preferred embodiment of the present invention, it should be understood that alternative embodiments are also within its scope.

I claim:

1. A marine propulsion device for a watercraft, comprising:

an engine having a cooling system through which water can flow in thermal communication with heat producing components of said engine;

an output shaft of said engine;

a housing structure, said output shaft of said engine being rotatably supported and at least partially contained within said housing structure;

a propeller shaft rotatably supported and at least partially contained within a gear case portion of said housing structure, said propeller shaft being in torque transmitting relation with said output shaft of said engine, said gear case portion of said housing structure having a tapered forward end; and a water inlet system comprising a first conduit formed within said housing structure, said first conduit being connected in fluid communication with a plurality of frontal inlet openings formed through a wall thickness of said tapered forward end of said gear case portion, a first of said plurality of frontal inlet openings being located above a horizontal centerline of said tapered forward end of said gear case portion and to the left side of a vertical centerline of said tapered forward end of said gear case portion, a second of said plurality of frontal inlet openings being located above said horizontal centerline of said tapered forward end of said gear case portion and to the right side of said vertical centerline of said tapered forward end of said gear case portion, a third of said plurality of frontal inlet openings being located below said horizontal centerline of said tapered forward end of said gear case portion and to the left side of said vertical centerline of said tapered forward end of said gear case portion, a fourth of said plurality of frontal inlet openings being located below said horizontal centerline of said tapered forward end of said gear case portion and to the right side of said vertical centerline of said tapered forward end of said gear case portion, each of said four frontal inlet openings having a forward facing area, said water inlet system being connected in fluid communication with said cooling system of said engine.

2. The marine propulsion device of claim 1, wherein:

each of said plurality of frontal inlet openings is an individual hole formed through said wall thickness of said gear case portion.

3. The marine propulsion device of claim 1, wherein:

two or more of said plurality of frontal inlet openings are formed by a single hole formed through said wall thickness of said gear case portion.

4. The marine propulsion device of claim 1, further comprising:

a first chamber formed within said tapered forward end of said gear case portion and connected in fluid communication between said first conduit and said plurality of frontal inlet openings formed through said wall thickness of said tapered forward end of said gear case portion.

5. The marine propulsion device of claim 1, wherein:

the effective diameter of said forward facing area of each of said plurality of frontal inlet openings is greater than said wall thickness.

6. The marine propulsion device of claim 5, wherein:

the effective diameter of said forward facing area of each of said plurality of frontal inlet openings is at least 25% greater than said wall thickness.

7. The marine propulsion device of claim 1, further comprising:

a plurality of side inlet openings formed through a side of said housing structure.

8. The marine propulsion device of claim 7, further comprising:

a second conduit formed within said housing structure in fluid communication with said plurality of side inlet openings.

9. The marine propulsion device of claim 8, wherein:

said first and second conduits are connected in fluid communication with each other and with said cooling system of said engine.

10. The marine propulsion device of claim 9, further comprising:

a water pump disposed within said housing structure and connected in fluid communication with said first and second conduits between said cooling system of said engine and said first and second conduits.

11. The marine propulsion device of claim 1, wherein:

said marine propulsion system is an outboard motor.

12. A marine propulsion device for a watercraft, comprising:

an engine having a cooling system through which water can flow in thermal communication with heat producing components of said engine;

an output shaft of said engine;

a housing structure, said output shaft of said engine being rotatably supported and at least partially contained within said housing structure;

a propeller shaft rotatably supported and at least partially contained within a gear case portion of said housing structure, said propeller shaft being in torque transmitting relation with said output shaft of said engine, said gear case portion of said housing structure having a tapered forward end;

a water inlet system comprising a first conduit formed within said housing structure, said first conduit being connected in fluid communication with a plurality of frontal inlet openings formed through a wall thickness of said tapered forward end of said gear case portion, a first of said plurality of frontal inlet openings being located above a horizontal centerline of said tapered forward end of said gear case portion and to the left side of a vertical centerline of said tapered forward end of said gear case portion, a second of said plurality of frontal inlet openings being located above said horizontal centerline of said tapered forward end of said gear case portion and to the right side of said vertical centerline of said tapered forward end of said gear case portion, a third of said plurality of frontal inlet openings being located below said horizontal centerline of said tapered forward end of said gear case portion and to the left side of said vertical centerline of said tapered forward end of said gear case portion, a fourth of said plurality of frontal inlet openings being located below said horizontal centerline of said tapered forward end of said gear case portion and to the right side of said vertical centerline of said tapered forward end of said gear case portion, each of said four frontal inlet openings having a forward facing area, said water inlet system being connected in fluid communication with said cooling system of said engine; and a first chamber formed within said tapered forward end of said gear case portion and connected in fluid communication between said first conduit and said plurality of frontal inlet openings formed through said wall thickness of said tapered forward end of said gear case portion, the effective diameter of said forward facing area of each of said plurality of frontal inlet openings being greater than said wall thickness.

13. The marine propulsion device of claim 12, wherein:

each of said plurality of frontal inlet openings is an individual hole formed through said wall thickness of said gear case portion.

14. The marine propulsion device of claim 13, wherein:

two or more of said plurality of frontal inlet openings are formed by a single hole formed through said wall thickness of said gear case portion.

15. The marine propulsion device of claim 14, wherein:

the effective diameter of said forward facing area of each of said plurality of frontal inlet openings is at least 25% greater than said wall thickness.

16. The marine propulsion device of claim 12, further comprising:

a plurality of side inlet openings formed through a side of said housing structure; and a second conduit formed within said housing structure in fluid communication with said plurality of side inlet openings, said first and second conduits being connected in fluid communication with each other and with said cooling system of said engine.

17. The marine propulsion device of claim 16, further comprising:

a water pump disposed within said housing structure and connected in fluid communication with said first and second conduits between said cooling system of said engine and said first and second conduits.

18. The marine propulsion device of claim 17, wherein:

said marine propulsion system is a stern drive unit.

19. A marine propulsion device for a watercraft, comprising:

an engine having a cooling system through which water can flow in thermal communication with heat producing components of said engine;

an output shaft of said engine;

a housing structure, said output shaft of said engine being rotatably supported and at least partially contained within said housing structure;

a propeller shaft rotatably supported and at least partially contained within a gear case portion of said housing structure, said propeller shaft being in torque transmitting relation with said output shaft of said engine, said gear case portion of said housing structure having a tapered forward end;

a water inlet system comprising a first conduit formed within said housing structure, said first conduit being connected in fluid communication with a plurality of frontal inlet openings formed through a wall thickness of said tapered forward end of said gear case portion, a first of said plurality of frontal inlet openings being located above a horizontal centerline of said tapered forward end of said gear case portion and to the left side of a vertical centerline of said tapered forward end of said gear case portion, a second of said plurality of frontal inlet openings being located above said horizontal centerline of said tapered forward end of said gear case portion and to the right side of said vertical centerline of said tapered forward end of said gear case portion, a third of said plurality of frontal inlet openings being located below said horizontal centerline of said tapered forward end of said gear case portion and to the left side of said vertical centerline of said tapered forward end of said gear case portion, a fourth of said plurality of frontal inlet openings being located below said horizontal centerline of said tapered forward end of said gear case portion and to the right side of said vertical centerline of said tapered forward end of said gear case portion, each of said four frontal inlet openings having a forward facing area, said water inlet system being connected in fluid communication with said cooling system of said engine;

a first chamber formed within said tapered forward end of said gear case portion and connected in fluid communication between said first conduit and said plurality of frontal inlet openings formed through said wall thickness of said tapered forward end of said gear case portion, the effective diameter of said forward facing area of each of said plurality of frontal inlet openings being greater than said wall thickness;

a plurality of side inlet openings formed through a side of said housing structure; and a second conduit formed within said housing structure in fluid communication with said plurality of side inlet openings, said first and second conduits being connected in fluid communication with each other and with said cooling system of said engine.

20. The marine propulsion device of claim 19, further comprising:

a water pump disposed within said housing structure and connected in fluid communication with said first and second conduits between said cooling system of said engine and said first and second conduits.

* * * * *